US007146019B2

(12) United States Patent
Levitsky

(10) Patent No.: US 7,146,019 B2
(45) Date of Patent: Dec. 5, 2006

(54) PLANAR RIBBON ELECTRO-ACOUSTIC TRANSDUCER WITH HIGH SPL CAPABILITY AND ADJUSTABLE DIPOLE/MONOPOLE LOW FREQUENCY RADIATION

(76) Inventor: Igor Levitsky, 22 Post Oak Drive, Richmond Hill, Ontario, L4E 4 G8 (CA)

( * ) Notice: Subject to any disclaimer, the term of this patent is extended or adjusted under 35 U.S.C. 154(b) by 223 days.

(21) Appl. No.: 10/238,043

(22) Filed: Sep. 5, 2002

(65) Prior Publication Data

US 2004/0047488 A1 Mar. 11, 2004

(51) Int. Cl.
*H04R 25/00* (2006.01)

(52) U.S. Cl. ..... 381/399; 381/176; 381/421

(58) Field of Classification Search ..... 381/399, 381/115, 117, 152, 171, 173, 176, 177, 412, 381/421

See application file for complete search history.

(56) References Cited

U.S. PATENT DOCUMENTS 4,337,379 A * 6/1982 Nakaya ..... 381/408
4,527,017 A * 7/1985 Kopinga et al. ..... 381/421
5,148,493 A * 9/1992 Bruney ..... 381/408
6,154,557 A * 11/2000 Montour et al. ..... 381/117

* cited by examiner

*Primary Examiner*—Suhan Ni
(74) *Attorney, Agent, or Firm*—W. Edward Johansen

(57) ABSTRACT

A planar electro-acoustic transducer has an adjustable back cap option that provides a dipole/monopole radiation that has different roll-off characteristics. The planar electro-acoustic transducer includes a diaphragm and a plurality of front and rear magnetic bars. Each magnetic bar has a side facing the diaphragm and disposed adjacent thereto. The thickness of each rear magnetic bar is larger than the thickness of each front magnetic bar. The thickness of each front magnetic bar is less than a quarter-wavelength of a cavity resonance at 10 kilohertz. The planar electro-acoustic transducer also includes a non-magnetic acoustically transparent metallic mesh that is disposed coplanarly with the sides of the front and rear magnetic bars that face the diaphragm.

11 Claims, 3 Drawing Sheets

PLANAR RIBBON ELECTRO-ACOUSTIC TRANSDUCER WITH HIGH SPL CAPABILITY AND ADJUSTABLE DIPOLE/MONOPOLE LOW FREQUENCY RADIATION

BACKGROUND OF THE INVENTION

U.S. Pat. No. 3,013,905 teaches a transducer that includes a magnet plate and a membrane. The magnetic plate is made from a highly coercive oriented ferrite material, e.g. the barium ferrite commercially known as "Indox V" of a high coercive force. The high coercive force is of the order of 2000 oersteds. It is magnetized in such a manner that alternating north poles and south poles extend in parallel over the entire length of the magnetic plate. Between each of two vicinal poles the flux runs through the depth of the magnetic plate. The flux can be conceived as a horseshoe magnet. The membrane is a pliable sheet of non-magnetic material, such as a polyester plastic material, of a thickness of about 0.01 millimeter. On it, a conductor of a material, such as aluminum, is printed in the form of a very thin, flat band that is pliable and has very low mechanical impedance. The membrane is substantially coextensive with the magnetic plate, tautly stretched above the plate at a distance of about 2.0 millimeters or less and secured at its edges in any suitable conventional manner. The conductor is continuous and runs in parallel stretches from end to end of the membrane, returning at the ends in short arcs. The stretches are in registry with the magnetic gaps (which expression does not, in this case, imply a conventional air, gap as the magnetic plate has a stretch that is a continuous plane surface) between consecutive opposite poles of the magnetic plate. With a gap between poles of the magnet there is a stretch with the gap between the poles of magnet 3*b*. At its ends the conductor has two or more terminals for connection to the input or output circuit, as the case may be. The magnetic plate has a plurality of holes, for the equalization of the air pressure in the gap between the magnet plate and membrane. When an electric current flows in the conductor, its direction is reversed from stretch to stretch of the conductor. Each change of direction corresponds to a change of direction of the magnetic field or, in other words, the vector product of the current with the magnetic field has the same sign in all parts of the conductor. The membrane thus oscillates in phase over its entire surface with the frequency of the alternating current passing through the conductor. The magnetic plate is built up from discrete bars mounted in parallel on a soft-iron, perforated armature plate 4*a* with equal gaps between them. Their top faces form alternately north and south poles.

U.S. Pat. No. 4,484,037 teaches a ribbon-type electro-acoustic transducer which has a magnetic system. The magnetic system includes an upper plate and a center pole between which an air gap is formed. A diaphragm on which conductors are arranged is disposed in the air gap. The upper plate includes two plate-shaped parts between which a space is formed in which an edge portion of the diaphragm is located. This results in a more homogeneous magnetic field so that the transducer distortion may be reduced. Moreover, the transducer sensitivity is improved and is suitable for handling signals in the mid-range audio frequency spectrum. The cavity enclosed by the magnet system and the diaphragm can be acoustically coupled, be via an additional cavity to a bass-reflex duct or an additional passive radiator diaphragm.

U.S. Pat. No. 5,850,461 teaches a diaphragm mounting system for flat acoustic planar magnetic and electrostatic transducers. The system incorporates opposing frame sections. Each frame section defines a clamping or peripheral surface area and an internal or central area through which acoustic waves may pass from the diaphragm. The diaphragm is first placed on one frame section with zero plus tension. The second frame section includes a protruding ridge extending substantially along an inner edge of the central area which ridge defines a border for a sound producing area of the diaphragm. During assembly of the two frame sections, the ridge engages the diaphragm to place predetermined tension on the diaphragm as the sections are joined. The profile of the ridge may be shaped to provide predetermined biaxial tension in a diaphragm of generally rectangular shape.

U.S. Pat. No. 4,471,172 teaches a planar diaphragm type magnetic transducer with magnetic circuit in which the magnet strips on the soft iron plate and confronting the diaphragm are arranged in a sequence south, north, north, south, south, north, north, south, et seq. The magnet strips are spaced across the transducer and the metal plates on which the magnet strips lie have apertures to make the plates acoustically transparent. Conductors are grouped in runs on the diaphragm opposite alternate pairs of magnet strips. The magnet strips have magnetic poles of opposite polarity at their front faces.

U.S. Pat. No. 6,104,825 teaches a planar magnetic transducer which includes a frame, a diaphragm, an electrical conductor and a plurality of magnets. The diaphragm is secured to the frame and has an active surface area under tension spaced inwardly of the frame. The electrical conductor is disposed on the active surface area of the diaphragm. The magnets are mounted so that they are spaced from said diaphragm.

Stage Accompany has its Air-System. The Active Intercooled Ribbon system is a part of the top touring system of Stage Accompany that is the Performer range. A fan, that systems amplifier controls, blows air directly on the voice-coil/diaphragm, reducing power compression and increasing power handling from 60 to 120 W continuously. The device described uses air blow mechanism to cool the ribbon driver diaphragm and thus provide better power handling, less power compression and ultimately higher SPL (signal pressure level) output.

An article by H. Nakajima, M. Ugaji, H. Syuama, is entitled "Tweeter Using New Structure and New Material for Diaphragm (Direct-Drive Ribbon Tweeter))", *Loudspeakers* Volume 2, is an anthology of articles from the *Journal of the Audio Engineering Society,* Volume 26 through Volume 31 (1978 to 1983), AES. New York, 1984, pages 257–262. This article describes a new development on planar ribbon transducers and among other aspects of the design it addresses the issue of thermal stability and power handling of such transducer. The high working temperature and stability of the driver developed by authors are achieved by using a polyimide diaphragm material one of the most heat resistant film available.

A "cavity resonance" is a parasitic resonance created in the cavity between the diaphragm and the output opening of a transducer. This resonance requires the use of special corrective notch filter.

The inventor hereby incorporates the above patents by reference and other described technologies.

SUMMARY OF THE INVENTION

The present invention is directed to an electro-acoustic transducer. The transducer includes a diaphragm with areas of multiple electrical conductors, two rows of magnetic bars, two metal plates, clamping frame, non-magnetic acoustically transparent metal grilles, optional, detachable back cups of different size. The diaphragm is clamped in the clamping frame and is positioned between the two rows of magnetic bars. Each row of magnetic bars is in close proximity to the clamped diaphragm. Each metal plate has holes. The holes correspond to spacing areas between the magnetic bars and acoustically connect the diaphragm to outside media. The magnetic bars are sequentially located on the metal plates with spacing between the magnetic bars. The diaphragm is secured to the clamping frame and has an active surface area under tension spaced inwardly of the clamping frame. The acoustically transparent grilles that can be made from non-magnetic metal mesh (bronze, stainless steel, brass) and shaped in a form of inverted meander are placed in the spacing areas between magnets. The grilles positioned in such manner that their two vertical sides are in close contact with magnets and their horizontal flat side are coplanar with the sides of the magnet bars facing the diaphragm. The transducer has different options for rear acoustic loading. One option is provided by absence of rear cap. The other options imply the use of the back cups that provide a closed cavity behind the diaphragm with different total system quality factor Q.

In the first aspect of the invention the planar ribbon transducer has different rear loading conditions allowing for a greater flexibility in shaping frequency response required for different applications such as: high fidelity consumer systems with dipole tweeter, horn loading, multiple driver line arrays. The transducer operates as a dipole radiator when the back cup is absent and sound waves travel freely through the spacing areas between rear magnets. The other embodiment implies the use of the closed back cup that provides the smoothest low frequency roll-off with quality factor Q of the whole system less than 1.

An aspect of yet another embodiment implies the use of the closed back cup that provides the quality factor Q larger than 1 with boosted low frequency roll-off. In those two latter embodiments the transducer operates as a monopole radiator.

In a second aspect of the invention the planar ribbon transducer has increased sensitivity and consequently higher SPL capability and smoother frequency response. The rear magnetic bars have larger thickness in the direction perpendicular to the diaphragm in relation to the frontal magnetic bars.

In a third aspect of the invention the transducer has higher power handling and consequently higher signal level pressure (SPL) capability due to implementation of acoustically transparent non-magnetic grilles in the spacing between the magnetic bars. The grilles are made from metal and are located in such manner that provides effective absorption and conduction of heat away from the diaphragm.

In a fourth aspect of the invention the transducer has higher sensitivity and higher power handling producing higher SPL capability due to special distribution of conductors in the gap between magnetic bars.

Other aspects and many of the attendant advantages will be more readily appreciated as the same becomes better understood by reference to the following detailed description and considered in connection with the accompanying drawing in which like reference symbols designate like parts throughout the figures.

The features of the present invention which are believed to be novel are set forth with particularity in the appended claims.

DESCRIPTION OF THE PREFERRED EMBODIMENT

Figure 1:
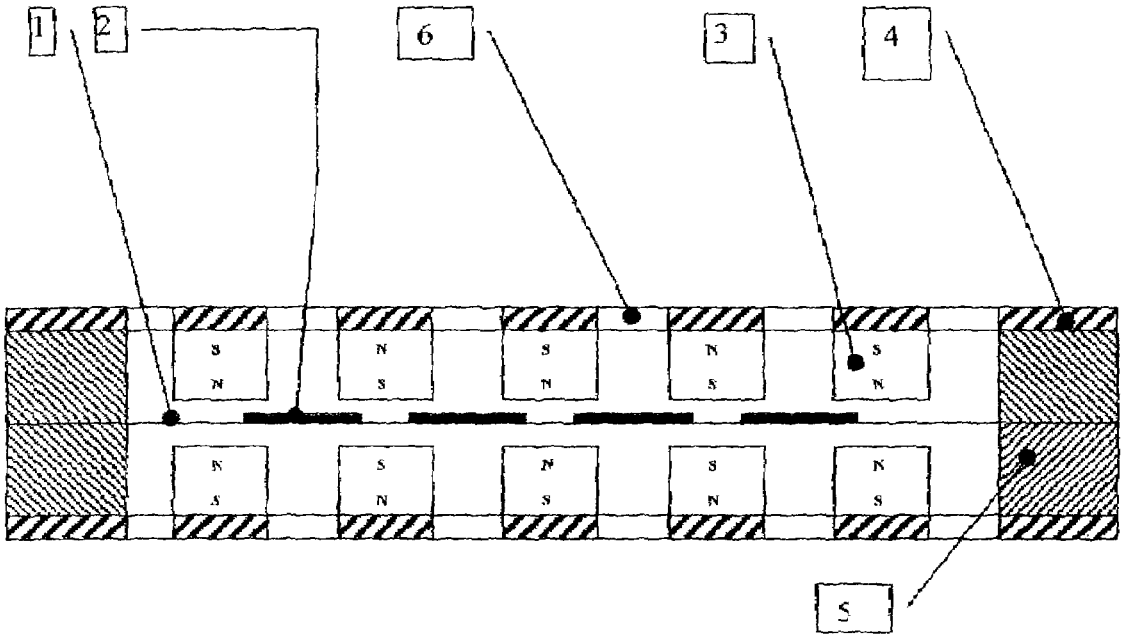
Fig1. Prior art
FIG. 1 is a schematic drawing of a planar magnetic transducer of the prior art.

Referring to FIG. 1 a planar panel transducer 10 includes a diaphragm 11 with areas of multiple electrical conductors 12, two rows of magnet-bars 13, two metal plates 14 and a frame 15. The diaphragm 11 is clamped in the frame 15 and is positioned between the two rows of magnet-bars 13. Magnets are sequentially located on metal plates 14 with spacing between the magnets. The metal plates 14 have holes 16 which correspond to spacing areas between magnet-bars 13 and which acoustically connect the diaphragm 11 to outside media. The magnet-bars 13 are magnetized in a direction perpendicular to the metal plates 14 so that a magnet-bar 13 from one side of a diaphragm and the opposite magnet-bar 13 from the other side of diaphragm are facing the diaphragm 11 and each other with the same magnetic poles either S or N. Each adjacent magnet-bar 13 that is located on the same side of the diaphragm 11 has the opposite direction of magnetization, thus each following magnet-bar 13 faces the diaphragm with the opposite magnetic pole, following the sequence N, S, N, S, N and so on. Magnetic field created by the magnet-bar arrangement has the maximum inductance vector B in a plane of the diaphragm 11 across the lines of the multiple electrical conductors 12. When electrical signal is applied to the diaphragm 11, the current that flows through multiple electrical conductors 12 interacts with the magnetic field and resulting electromotive force makes the diaphragm 11 vibrate in the direction perpendicular its plane. Vibrating, the diaphragm 11 radiates sound waves that emanate through the spacings between the magnet-bars 13 and the holes 16 in the metal plates 14 in both directions from the diaphragm 11. Different acoustical loading conditions may be applied to the design such as using a metal plate without holes.

The use of rear earth magnetic materials such as Neodymium, which has become the magnetic material of choice in recent years, allows significant reduction of size and efficiency improvement of such design. As a result such design can provide very high quality sound with minimal front to back space required, thus allowing the building of "flat" panel planar loudspeakers for many critical applications.

There are certain issues and limitations inherent for this design. Such transducer has fixed frequency response and spatial radiation characteristic. This limits its applications. Some high-end and reference quality applications require very accurate high frequency reproduction with minimal reflections from the rear of the enclosure or back cup. These reflections being reradiated back through the diaphragm introduce distortion to the original signal. Surround sound home theater systems also benefit from dipole transducer according THX specifications. That is why a dipole radiator is often preferable for certain applications despite the fact that it has lower sensitivity across the lower part of its operating range.

Yet other applications such as in professional systems require maximum sensitivity and SPL output. These applications often use a transducer with attached horn or a multiple driver array when drivers are tightly spaced together creating a line array. All these different applications require different type of transducer, the latter two applications use a monopole radiator with diaphragm closed from the back without any rear radiation. Having a transducer with readily available options that maximally suit to each of these applications is a significant benefit.

U.S. Pat. No. 4,484,037 teaches a ribbon-type electro-acoustic transducer that can have a diaphragm loaded at the rear with vented cavity. However a vented cavity is not effective for a ribbon driver. A vented enclosure is mostly used for woofers that have a significant air volume displacement due to their large excursion at low frequency. A planar ribbon driver has inherently very small diaphragm excursion and is always used for mid and high frequency reproduction where the diaphragm displacement is further limited to the minimum. Furthermore a ribbon planar transducer has inherently very high total Q when loaded with rear enclosure (usually in the vicinity or more than 1). It is a well-known fact that a transducer with such high Q does not operate effectively in a vented enclosure. Another problem that limits the flux density and hence sensitivity in the planar transducer of the prior art is the limited thickness of the magnets. Professional sound reinforcement systems require maximum possible SPL output. Using readily available high-energy grades (40 MGO and higher) Neodymium magnets is one way to increase sensitivity. Assuming that the length and width of the transducer is the same, another seemingly apparent way to gain sensitivity is increasing the thickness of the magnets in the direction perpendicular the diaphragm. The problem however lies in the fact that the thickness increase of the frontal magnets is detrimental to the performance of the transducer.

Firstly, when the frontal magnet bar thickness is larger than 8–9 mm there is a parasitic resonance created in the cavity between the diaphragm and the frontal output opening of a transducer. This resonance requires the use of special corrective notch filter. See page 4 of the website http://www.bgcorp.com/Downloads/RDdrivers.pdf.

Secondly, a mass of air volume that exists in this cavity acts as a low pass filter effectively reduces the high frequency output. In other words, the thicker the frontal magnets are, the greater is high frequency attenuation.

Yet another issue inherent of the prior art is the power handling limitation imposed by the limited working temperature of the diaphragm. Using different contemporary materials with high working temperature, such as polyimide, can improve the power handling. But still, there is a major area of conductors between the magnet-bars 13 of the planar panel transducer 10 that is exposed to air without any metal parts being in close proximity that would effectively absorb heat generated in said conductors during high power operation. Practice shows that this middle portion of conductors is the weakest part of the diaphragm and a planar transducer most often fail due to overheating and burning of the diaphragm in this place.

A ribbon-type electro-acoustic transducer manufactured by Stage Accompany may have an Active Inter-cooled Ribbon device. See http://www.stageaccompany.com/cd-load.html). The described Active Inter-cooled Ribbon (AIR) device is based on a fan that blows air to cool the ribbon driver diaphragm and provide better power handling, less power compression and ultimately higher SPL output. While this device indeed works, it significantly complicates the whole system, dramatically reduces reliability (if the device fails, the driver fails immediately without additional air flow), significantly increases the cost and ultimately increases distortion due to signal modulations generated by blowing air.

Figure 2:
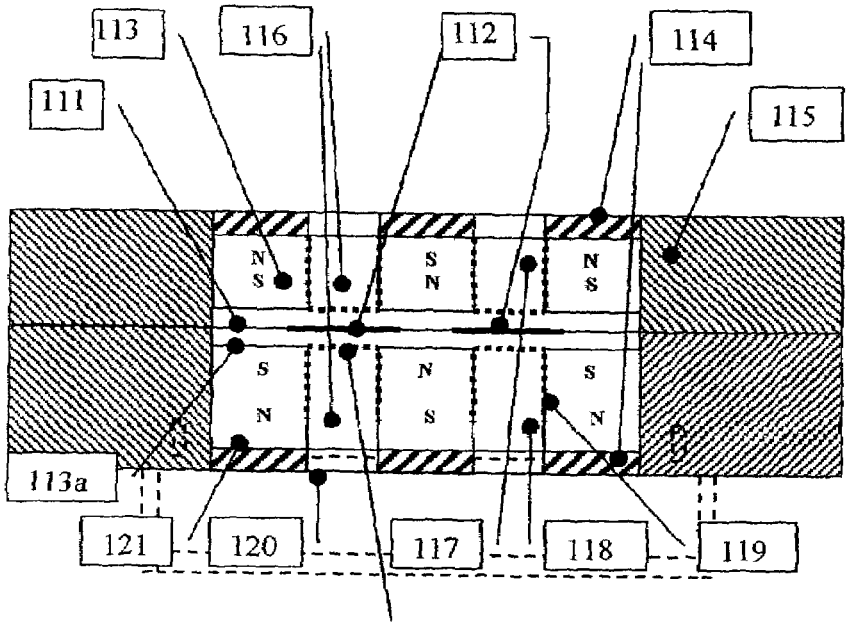
FIG. 2 is a schematic drawing of a planar magnetic transducer according to the present invention.

Referring to FIG. 2 a planar ribbon transducer 110 includes a diaphragm 111 with areas of multiple electrical conductors 112, two rows of front and rear magnet-bars 113 and 113*a*, two metal plates 114 and a frame 115. The diaphragm 111 is clamped in the frame 115 and is positioned between the two rows of front and rear magnet-bars 113 and 113*a*. The front and rear magnet-bars 113 and 113*a* are sequentially located on metal plates 114 with spacing between the magnets. The metal plates 114 have holes 116 which correspond to spacing areas between the front and rear magnet-bars 113 and 113*a* and which acoustically connect the diaphragm 111 to outside media. The front and rear magnet-bars 113 and 113*a* are magnetized in a direction perpendicular to the metal plates 114 so that a front magnet-bar 113 from one side of a diaphragm and the opposite rear magnet-bar 113*a* from the other side of diaphragm are facing the diaphragm 111 and each other with the same magnetic poles either S or N. Each of the adjacent front and back magnet-bars 113 and 113*a* that is located on the same side of the diaphragm 111 has the opposite direction of magnetization, thus each of following front and rear magnet-bars 113 and 113*a* faces the diaphragm with the opposite magnetic pole, following the sequence N, S, N, S, N and so on. Magnetic field created by the magnet-bar arrangement has the maximum inductance vector B in a plane of the diaphragm 111 across the lines of the multiple electrical conductors 112. When electrical signal is applied to the diaphragm 111, the current that flows through multiple electrical conductors 112 interacts with the magnetic field and resulting electromotive force makes the diaphragm 111 vibrate in the direction perpendicular to its plane. Vibrating, the front and rear magnet-bars 113 and 113*a* radiate sound waves that emanate through the spacings between the front and rear magnet-bars 113 and 113*a* and the holes 116 in the metal plates 114 in both directions from the diaphragm 111. The transducer 110 has rear magnet bars 113*a* thicker than front magnet bars 113 in the direction perpendicular to the diaphragm 111. The rear magnet bars 113*a* have maximum thickness that is economically justifiable in increasing magnetic flux density in the magnetic gap and thus the total transducer sensitivity and max SPL capability. The thickness of the rear magnet-bars 113*a* does not affect the frontal cavity resonance and high frequency filtering due to the added air mass at the front of the diaphragm. Therefore, increasing rear magnet thickness will not affect the quality of the primary direct sound radiated through the frontal holes towards a listener. At the same time the thickness of the front magnet bars 113 is kept less than 8.5 mm that corresponds to a quarter-wavelength of the cavity resonance at 10 kHz. This allows avoiding of any peaking resonance below 10 kHz that is detrimental to the transducer performance. The nature of the cavity resonance above 10 kHz is much less pronounced due to the increased dampening at higher frequencies. The total Q of such resonance is low enough to not to affect the transducer performance. The added benefit of the different magnet bar thickness is the creation of dissimilar acoustic loading conditions for the diaphragm from the front and rear. This helps to reduce small frequency response irregularities at high frequency due to reflections from the edges of magnet bars and resonance. The acoustically transparent non-magnetic metal grilles 117 are placed in the spacing areas 116. The grilles 117 that can be made from non-magnetic metal mesh (bronze, stainless steel, brass) and shaped in a form of inverted meander are positioned in such manner that their two vertical sides are in close contact with front and rear magnet-bars 113 and 113*a* and their horizontal flat sides are coplanar with the sides of the front and rear magnet bars 113 and 113*a* facing the diaphragm 111. Using metal grilles 117 in the transducer allows for significant reduction of the temperature of the conductors 112 that are located in the middle of the gap away from the magnetic bars. Having a meander shape and being in the close proximity to the central portion of the conductors 112, the grilles 117 effectively transfer heat to the front and rear magnet-bars 113 and 113*a* and further to the rest of the transducer metal body. The conductors 112 are usually made from aluminum strips with 10–25 microns in thickness. The metal grilles 117 are usually made from a mesh that has higher specific density and a thickness about 0.5–0.8 mm. Therefore, conductors 112 have much smaller mass than the grille 117 and this fact makes the close proximity of the grilles 117 very effective in absorbing heat from the conductors 112.

The grilles 117 being acoustically transparent and non-magnetic do not interfere with sound radiation or with magnetic field in the gap. The reduction of the conductors' 112 temperature in its turn reduces power compression effect and increases maximum power handling and ultimately maximum SPL capability of the transducer.

Figure 3:
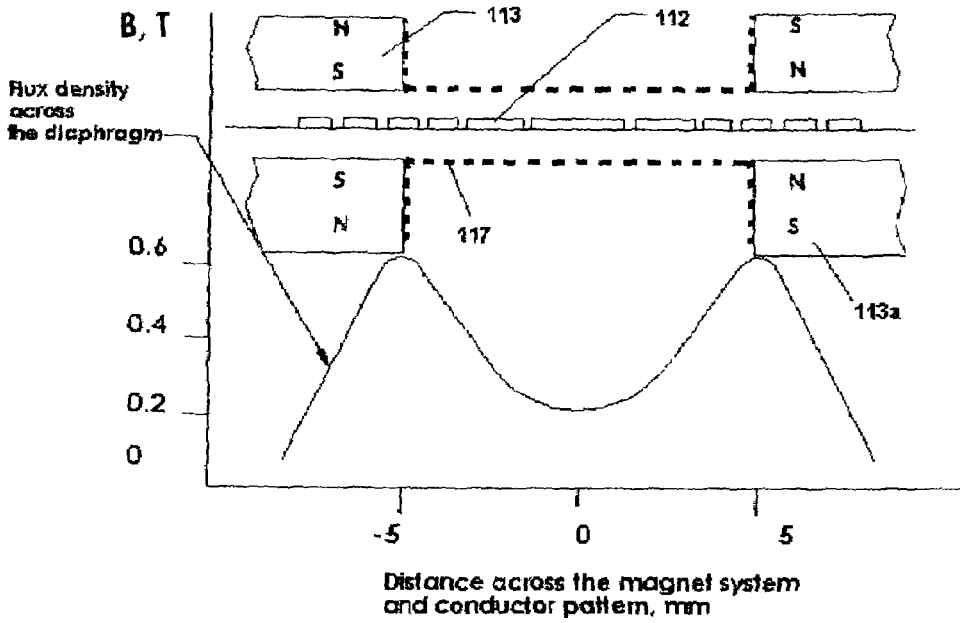
FIG. 3 is a schematic drawing of the special distribution of the conductors in relation to the magnets and flux density in the magnetic gap of the planar magnetic transducer of FIG. 2.

Referring to FIG. 3, the proposed transducer 110 has conductors 112 distributed in such way that the conductor in the middle of the gap between two horizontally adjacent front and rear magnet-bars 113 and 113*a* has the largest width. The width of other conductors decreases as their proximity to the magnetic bars 113 and 113*a* increases. The conductors with the smallest width are located under the front and rear magnet-bars 113 and 113*a* and in the close proximity to their edge. Said conductor width distribution has a double benefit.

Figure 4:
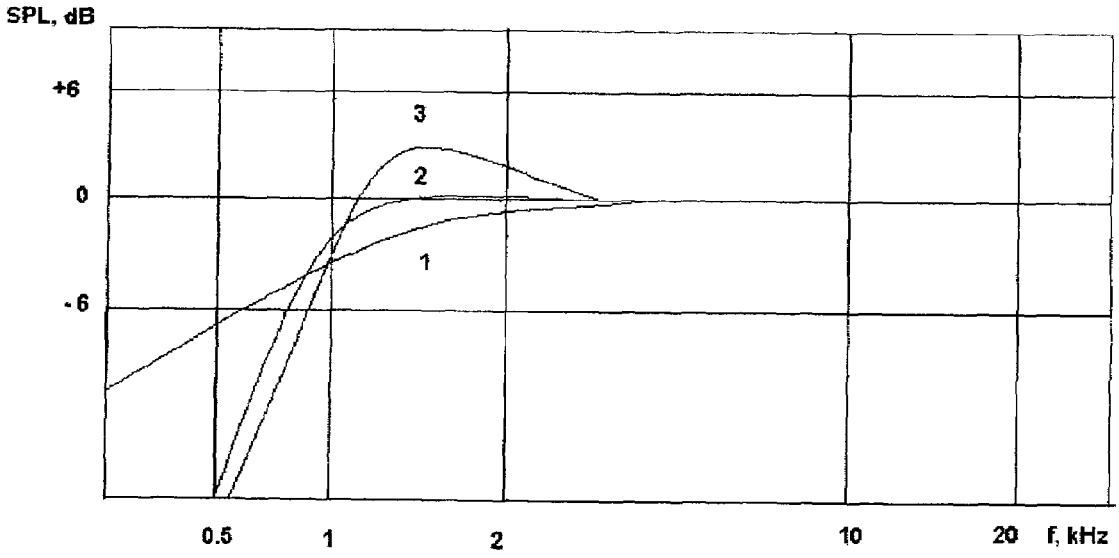
FIG. 4 is a schematic drawing of different low frequency roll-off characteristics of the planar magnetic transducer of FIG. 2.
Figure 5:
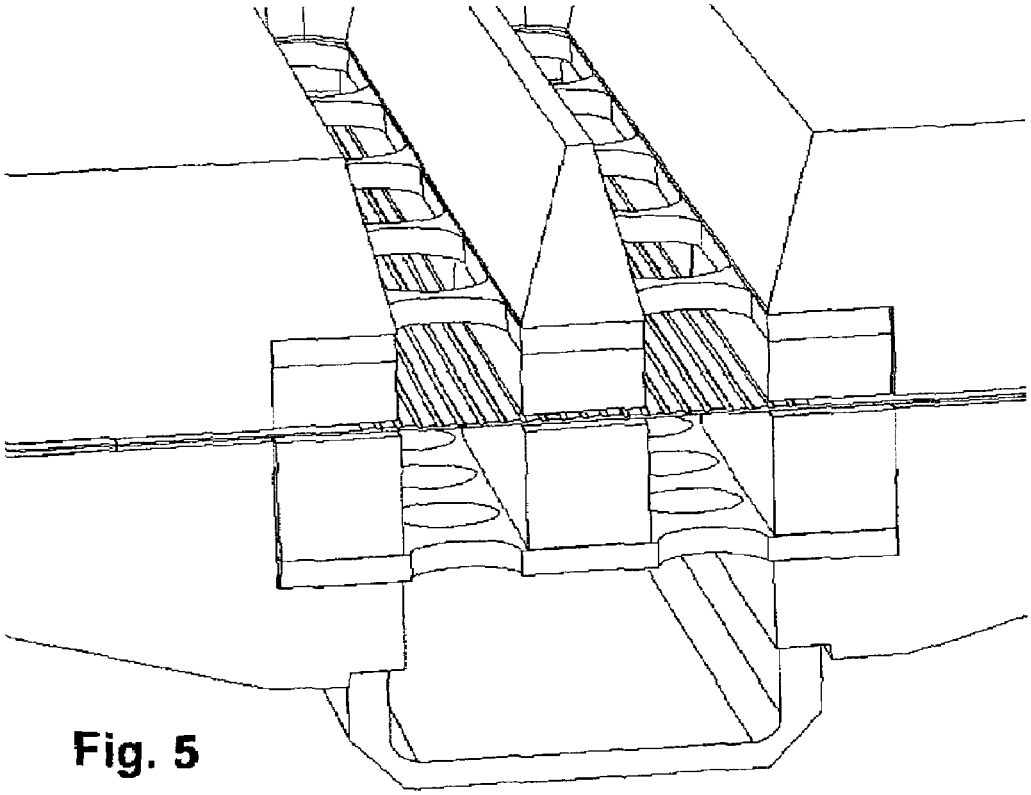
FIG. 5 is a partial perspective of the planar magnetic transducer of FIG. 2.

Referring to FIG. 2 in conjunction with FIG. 4, the transducer 110 has different rear loading arrangements. It can operate as a dipole or a monopole radiator. The rear side of the transducer can be either open with sound radiating to the rear through spacing areas 116 as well as to the front through spacing areas 116 (dipole radiator), or it can have a sealed back cup 118 with internal volume 119 or a back cup 120 with internal volume 121 attached from the rear over the rear spacing areas 116. In the latter case the transducer operates as a monopole radiator, radiating sound only from the frontal side. The different internal volumes 118 and 119 allow for different low frequency roll-off characteristics for the transducer 110. The transducer 110 in a dipole radiator mode has a normalized frequency response 1. This type of response provides possibilities for lower crossover frequency to a matching low frequency transducer in a system. The dipole version of the transducer also has a different radiation pattern. Its dispersion will have a "figure 8" shape having nulls at 90 degrees to the sides and lobes at 0 and 180 degrees (front and back). The dipole version of the transducer has lower distortion due to the absence of internal reflections affecting the diaphragm. All this is extremely beneficial for some consumer applications requiring the ultimate performance and spacious open presentation enhanced by controlled room reflections from the rear wall. A significant attenuation of radiated energy to the sides of the transducer is beneficial yet for another application for surround sound loudspeakers installed in a close proximity to the sides or at the back of a listener. The transducer 110 in a monopole mode with back caps 118 or 120 installed has frequency responses of 3 and 2, respectively. The different back cup volume allows for matching different radiation conditions such as a single driver in a cabinet with or without horn or a line array of closely spaced multiple drivers. This also provides the maximum sensitivity and consequently SPL capabilities for the transducer in critical professional applications.

A first benefit is based on the fact that the wider conductors 112 that are in the middle of the gap have larger heat dissipation capability due to their larger surface. This helps to reduce the temperature of the conductors 112 that are located in the most critical central zone that does not have nearby front and rear magnet-bars 113 and 113*a* as heat absorbers. The conductors 112 that are located under and close to the front and rear magnet-bars 113 and 133*a* can be made relatively narrow, because their position provides efficient heat absorption and dissipation by the said magnet bars.

A second benefit relates to the typical distribution of magnetic flux density in the gap. This distribution is dictated by magnet system design and generally has a function of a "saddle" with minimum in the middle of the gap and maximum at the edges of front and rear magnet-bars 113 and 113*a*. It is known that sensitivity of a transducer is proportionate to BL factor, which is multiple of magnetic flux density B in a gap and conductor length L. Therefore placing more conductors of the transducer 110 in the region with highest B provides a higher sensitivity. The distribution of the conductors 112 results in more effective heat dissipation and more effective utilization of the magnetic energy in the gap. As a result the transducer 110 has higher power handling and higher sensitivity with lower signal compression and higher maximum SPL. All this ultimately transfers to lower signal power compression and higher SPL capabilities of the transducer 110.

One of the possible variations is a transducer with a magnet bars from one side only or one-sided combination of mentioned features such as grilles 117.

While this invention has been particularly shown and described with references to preferred embodiments thereof, it will be understood by those skilled in the art that various changes in form and details may be made therein without departing from the spirit and scope of the invention as defined by the appended claims.

It should be noted that the sketches are not drawn to scale and that distance of and between the figures are not to be considered significant.

Accordingly it is intended that the foregoing disclosure and showing made in the drawing shall be considered only as an illustration of the principle of the present invention.

What is claimed is:

1. A planar electro-acoustic transducer comprising:

a. a diaphragm;

b. a plurality of front magnetic bars each of which has a side facing said diaphragm and disposed adjacent thereto;

c. a plurality of rear magnetic bars each of which has a side facing said diaphragm and disposed adjacent thereto wherein the thickness of each of said rear magnetic bars is larger than the thickness of said front magnetic bars and wherein the thickness of each of said front magnetic is less than a quarter-wavelength of a cavity resonance at 10 kilohertz; and d. a plurality of conductors mechanically coupled to said diaphragm.

2. A planar electro-acoustic transducer according to claim 1 wherein said planar electro-acoustic transducer also includes a non-magnetic acoustically transparent metallic mesh disposed co-planarly with said sides of said front and rear magnetic bars that face said diaphragm whereby said non-magnetic acoustically transparent metallic mesh does not interfere with sound radiation or with magnetic field in the gap so that the reduction of the temperature of said conductors in its turn reduces power compression effect and increases maximum power handling and ultimately maximum SPL capability.

3. A planar electro-acoustic transducer according to claim 2 wherein said diaphragm has a plurality of conductors which are distributed in such a way whereby one of said conductors is disposed in the middle of a magnetic gap that is created between two horizontally adjacent magnetic bars has the largest width and whereby the width of other of said conductors decreases as their proximity to said magnetic bars increases and said conductors with the smallest width are located under said magnetic bars and in close proximity to their edge.

4. A planar electro-acoustic transducer according to claim 3 wherein said planar electro-acoustic transducer further includes two metal plates and an adjustable back cap option that provides a dipole/monopole radiation that has different roll-off characteristics.

5. A planar electro-acoustic transducer according to claim 1 wherein said conductors are formed by areas of multiple electrical conductors and wherein each of said front magnetic bars is smaller than each of said rear magnetic bars whereby said front and rear magnet-bars are magnetized in a direction perpendicular to said two metal plates so that one of said front magnet-bars from one side of said diaphragm and the opposite rear one of said rear magnet-bars from the other side of diaphragm are facing said diaphragm.

6. A planar electro-acoustic transducer according to claim 5 wherein said magnetic field created by the magnet-bar arrangement has the maximum inductance vector B in a plane of said diaphragm across the lines of said areas of multiple electrical conductors so that when electrical signal is applied to said diaphragm, current that flows through said areas of multiple electrical conductors interacts with the magnetic field and resulting electromotive force makes said diaphragm vibrate in the direction perpendicular to its plane with this vibrating, said front and rear magnet-bars radiate sound waves that emanate through spacing between said front and rear magnet-bars and holes in said two metal plates both directions from said diaphragm.

7. A planar electro-acoustic transducer according to claim 6 wherein said rear magnet bars are thicker than said front magnet bars in the direction perpendicular to said diaphragm wherein said rear magnet bars have maximum thickness that is economically justifiable in increasing magnetic flux density in the magnetic gap and thus the total transducer sensitivity and max SPL capability and wherein the thickness of said rear magnet-bars does not affect the frontal cavity resonance and high frequency filtering due to the added air mass at the front of the diaphragm thereby increasing the thickness of said rear magnet bars will not affect the quality of the primary direct sound radiated through the frontal holes towards a listener and wherein at the same time the thickness of said front magnet bars is kept less than 8.5 mm that corresponds to a quarter-wavelength of the cavity resonance at 10 kHz thereby avoiding of any peaking resonance below 10 kilohertz that is detrimental to performance.

8. A planar electro-acoustic transducer comprising:

a. a diaphragm;

b. a plurality of front magnetic bars each of which has a side facing said diaphragm and disposed adjacent thereto;

c. a plurality of rear magnetic bars each of which has a side facing said diaphragm and disposed adjacent thereto wherein the thickness of each of said rear magnetic bars is larger than the thickness of said front magnetic bars and wherein the thickness of each of said front magnetic is less than a quarter-wavelength of a cavity resonance at 10 kilohertz;

d. a plurality of conductors mechanically coupled to said diaphragm; and e. a non-magnetic acoustically transparent metallic mesh disposed co-planarly with said sides of said front and rear magnetic bars that face said diaphragm whereby said non-magnetic acoustically transparent metallic mesh does not interfere with sound radiation or with magnetic field in the gap so that the reduction of the temperature of said conductors in its turn reduces power compression effect and increases maximum power handling and ultimately maximum SPL capability.

9. A planar electro-acoustic transducer comprising:

a. a diaphragm;

b. a plurality of front magnetic bars each of which has a side facing said diaphragm and disposed adjacent thereto;

c. a plurality of rear magnetic bars each of which has a side facing said diaphragm and disposed adjacent thereto wherein the thickness of each of said rear magnetic bars is larger than the thickness of said front magnetic bars and wherein the thickness of each of said front magnetic is less than a quarter-wavelength of a cavity resonance at 10 kilohertz; and d. a plurality of conductors mechanically coupled to said diaphragm wherein said diaphragm has a plurality of conductors which are distributed in such a way whereby one of said conductors is disposed in the middle of a magnetic gap that is created between two horizontally adjacent magnetic bars has the largest width and whereby the width of other of said conductors decreases as their proximity to said magnetic bars increases and said conductors with the smallest width are located under said magnetic bars and in close proximity to their edge.

10. A planar electro-acoustic transducer according to claim 9 wherein said planar electro-acoustic transducer also includes a non-magnetic acoustically transparent metallic mesh disposed co-planarly with said sides of said front and rear magnetic bars that face said diaphragm whereby said non-magnetic acoustically transparent metallic mesh does not interfere with sound radiation or with magnetic field in the gap so that the reduction of the temperature of said conductors in its turn reduces power compression effect and increases maximum power handling and ultimately maximum SPL capability.

11. A planar electro-acoustic transducer according to claim 10 wherein said planar electro-acoustic transducer further includes two metal plates and an adjustable back cap option that provides a dipole/monopole radiation that has different roll-off characteristics.

* * * * *